US009403586B2

(12) United States Patent
Okamoto et al.

(10) Patent No.: US 9,403,586 B2
(45) Date of Patent: Aug. 2, 2016

(54) JET PROPELLED WATERCRAFT

(71) Applicant: YAMAHA HATSUDOKI KABUSHIKI KAISHA, Iwata-shi, Shizuoka (JP)

(72) Inventors: Yukitaka Okamoto, Shizuoka (JP); Hirofumi Anma, Shizuoka (JP); Masaru Suzuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/814,637

(22) Filed: Jul. 31, 2015

(65) Prior Publication Data

US 2016/0039505 A1 Feb. 11, 2016

(30) Foreign Application Priority Data

Aug. 8, 2014 (JP) ..... 2014-162715

(51) Int. Cl.
*B63H 11/11* (2006.01)
*B63H 11/107* (2006.01)

(52) U.S. Cl.
CPC ..... *B63H 11/11* (2013.01); *B63H 11/107* (2013.01)

(58) Field of Classification Search
CPC .... B63H 11/08; B63H 11/103; B63H 11/107; B63H 11/113; B63H 21/213; B63H 21/21; B63H 21/22; B63H 23/24
USPC ..... 440/1, 38, 40
See application file for complete search history.

(56) References Cited

U.S. PATENT DOCUMENTS

2013/0344754 A1 12/2013 Kinoshita

OTHER PUBLICATIONS

Okamoto et al., "Jet Propelled Watercraft," U.S. Appl. No. 14/814,645, filed Jul. 31, 2015.
Okamoto et al., "Jet Propelled Watercraft," U.S. Appl. No. 14/814,648, filed Jul. 31, 2015.
Kinoshita, "Small Vessel Propulsion System," U.S. Appl. No. 14/814,650, filed Jul. 31, 2015.

*Primary Examiner* — Lars A Olson
(74) *Attorney, Agent, or Firm* — Keating & Bennett, LLP

(57) ABSTRACT

A jet propelled watercraft includes a prime mover, a jet pump driven by the prime mover and jetting water from a jet port, a reverse gate changing a direction of the jet flow jetted from the jet pump, a shift actuator capable of moving the reverse gate to a plurality of shift positions, a reverse gate operator configured to set a position of the reverse gate, and a controller configured or programmed to prohibit startup of the prime mover when it is determined that the reverse gate operator is being operated.

13 Claims, 10 Drawing Sheets

JET PROPELLED WATERCRAFT

BACKGROUND OF THE INVENTION

1. Field of the Invention

The present invention relates to a jet propelled watercraft.

2. Description of the Related Art

United States Patent Application Publication No. 2013/0344754 discloses a jet propelled watercraft that includes a first accelerator operator (accelerator operator) provided in a right grip of a handle and a second accelerator operator (reverse gate operator) provided in a left grip of the handle. The jet propelled watercraft further includes an engine, a jet pump driven by the engine, a reverse gate, a shift actuator, and an ECU. The shift actuator moves the reverse gate to a forward drive position, a neutral position, and a reverse drive position. The ECU controls the engine and the shift actuator.

The first accelerator operator is mainly operated to drive the jet propelled watercraft forward. The second accelerator operator is mainly operated to drive the jet propelled watercraft in reverse or to reduce a forward speed of the jet propelled watercraft. The reverse gate can be disposed at the reverse drive position by operating the second accelerator operator. An operation amount of the first accelerator operator is detected by a first accelerator position sensor and an operation amount of the second accelerator operator is detected by a second accelerator position sensor. Based on the operation amounts of the first and second accelerator operators detected by the first and second accelerator position sensors, the ECU controls an engine speed (throttle opening degree) and a shift position of the reverse gate.

SUMMARY OF THE INVENTION

The inventors of preferred embodiments of the present invention described and claimed in the present application conducted an extensive study and research regarding a jet propelled watercraft, such as the one described above, and in doing so, discovered and first recognized new unique challenges and previously unrecognized possibilities for improvements as described in greater detail below.

With the jet propelled watercraft according to US Patent Application Publication No. 2013/0344754, the second accelerator operator (reverse gate operator) is not mechanically coupled to the reverse gate and therefore a large force is not required to operate the second accelerator operator. There is thus a possibility for an operator to operate the second accelerator operator unconsciously when the engine is being stopped. When the engine is started in a state where the second accelerator operator is operated, the jet propelled watercraft may be driven in reverse immediately after the engine is started.

In order to overcome the previously unrecognized and unsolved challenges described above, a preferred embodiment of the present invention provides a jet propelled watercraft including a body, a prime mover, a jet pump driven by the prime mover and jetting water from a jet port, a reverse gate changing a direction of the jet flow jetted from the jet pump, a shift actuator capable of moving the reverse gate, a reverse gate operator operated by an operator to set a position of the reverse gate, a reverse gate operation detector detecting an operation state of the reverse gate operator, and a controller configured or programmed to determine, in accordance with the operation state of the reverse gate operator detected by the reverse gate operation detector, whether or not the reverse gate operator is being operated and to prohibit startup of the prime mover when it is determined that the reverse gate operator is being operated. The shift actuator is capable of moving the reverse gate to a plurality of shift positions including at least a forward drive position, at which the direction of the jet flow is toward the rear of the body, and a reverse drive position, at which the direction of the jet flow is toward the front of the body.

With this arrangement, the startup of the prime mover is prohibited when it is determined that the reverse gate operator is being operated and therefore the body is prevented from being driven in reverse immediately after the startup of the prime mover.

In a preferred embodiment of the present invention, the reverse gate operation detector is configured to detect an operation amount of the reverse gate operator and the controller is configured or programmed to determine that the reverse gate operator is being operated when the operation amount of the reverse gate operator detected by the reverse gate operation detector is not less than a predetermined threshold. Whether or not the reverse gate operator is being operated is thus determined appropriately, and the prime mover startup prohibition when the reverse gate operator is being operated is performed appropriately.

In a preferred embodiment of the present invention, the reverse gate operation detector is configured to output a reverse gate position command signal in accordance with operation of the reverse gate operator and the controller is configured or programmed to determine that the reverse gate operator is being operated when the reverse gate position command signal is being output. With this arrangement, whether or not the reverse gate operator is being operated is determined based on whether or not the reverse gate position command signal is being output. The startup of the prime mover is thus prohibited under circumstances where there is a possibility for the reverse gate position to be changed in response to the position command signal. The startup of the prime mover is thus prohibited appropriately.

In a preferred embodiment of the present invention, the reverse gate operator includes a lever that is rotatingly operated by the operator.

In a preferred embodiment of the present invention, the reverse gate operation detector is configured to detect an operation angle of the lever and the controller is configured or programmed to determine that the reverse gate operator is being operated when the operation angle of the lever detected by the reverse gate operation detector is not less than a predetermined threshold. With this arrangement, the startup of the prime mover is prohibited when the operation angle of the lever is not less than the threshold. The startup of the prime mover is thus prohibited appropriately.

In a preferred embodiment of the present invention, the prime mover is an engine, a starter motor configured to start the engine is further included, and the controller is configured or programmed to determine, in accordance with the operation state of the reverse gate operator detected by the reverse gate operation detector, whether or not the reverse gate operator is being operated, and configured or programmed so as not to drive the starter motor when it is determined that the reverse gate operator is being operated. As a result, the starting of the engine in a state where the reverse gate operator is being operated is avoided.

A preferred embodiment of the present invention further includes an accelerator operator operated by the operator to set a rotational speed of the prime mover and an accelerator operation detector detecting an operation state of the accelerator operator, and the controller is configured or programmed to determine, in accordance with the operation state of the accelerator operator detected by the accelerator operation detector, whether or not the accelerator operator is being operated and to prohibit the startup of the prime mover when it is determined that the accelerator operator is being operated.

With this arrangement, the startup of the prime mover is prohibited when it is determined that the accelerator operator is being operated and therefore the rotational speed of the prime mover is suppressed to be low immediately after startup. Application of a large propulsive force to the body immediately after the startup of the prime mover is thus avoided.

In a preferred embodiment of the present invention, the reverse gate operation detector is configured to detect an operation amount of the reverse gate operator, the accelerator operation detector is configured to detect an operation amount of the accelerator operator, and the controller is configured or programmed to determine that the reverse gate operator is being operated when the operation amount of the reverse gate operator detected by the reverse gate operation detector is not less than a predetermined first threshold and to determine that the accelerator operator is being operated when the operation amount of the accelerator operator detected by the accelerator operation detector is not less than a predetermined second threshold differing from the first threshold.

With this arrangement, whether or not the accelerator operator is being operated and whether or not the reverse gate operator is being operated is appropriately determined respectively, and the prime mover startup prohibition when these operators are being operated is performed appropriately.

In a preferred embodiment of the present invention, the reverse gate operator includes a reverse lever that is rotatingly operated by the operator, the accelerator operator includes an accelerator lever that is rotatingly operated by the operator, the operation amount of the reverse gate operator is an operation angle of the reverse lever, and the operation amount of the accelerator operator is an operation angle of the accelerator lever.

With this arrangement, the operation states of the accelerator lever and the reverse lever are determined appropriately and therefore the prime mover startup prohibition when these are being operated are performed appropriately.

In a preferred embodiment of the present invention, the reverse gate operator is configured to receive a setting of the rotational speed of the prime mover by the operator, and the rotational speed of the prime mover corresponding to the first threshold and the rotational speed of the prime mover corresponding to the second threshold are equal or substantially equal. With this arrangement, operations of the reverse gate operator and the accelerator operator are determined based on the rotational speed of the prime mover. The operations of the reverse gate operator and the accelerator operator is thus determined from a standpoint of the magnitude of a propulsive force generated when the prime mover is started up. The prime mover start prohibition is controlled more appropriately.

In a preferred embodiment of the present invention, the reverse gate operator is configured to receive a setting of the rotational speed of the prime mover by the operator, and the rotational speed of the prime mover corresponding to the first threshold and the rotational speed of the prime mover corresponding to the second threshold differ. With this arrangement, the prime mover rotational speed that serves as a basis for determining operation differs between the reverse gate operator and the accelerator operator. The operations of the reverse gate operator and the accelerator operator is thus determined from a standpoint of the respective magnitudes of a forward drive propulsive force and a reverse drive propulsive force generated when the prime mover is started up. The prime mover startup prohibition is thus controlled even more appropriately.

In a preferred embodiment of the present invention, the reverse gate operator is configured to receive a setting of the rotational speed of the prime mover by the operator. With this arrangement, by prohibiting the startup of the prime mover in a state where the reverse gate operator is being operated, generation of a large propulsive force is avoided when the prime mover is started up.

In a preferred embodiment of the present invention, the shift actuator is configured to move the reverse gate to the forward drive position, the reverse drive position, and a neutral position between the forward drive position and the reverse drive position, and the controller is configured or programmed to control the shift actuator to move the reverse gate to the neutral position when the prime mover is started up.

With this arrangement, if in the process of starting up the prime mover, the reverse gate is at the forward drive position or the reverse drive position, the reverse gate is moved to the neutral position when the prime mover is started up. The body is thus prevented from being driven forward or in reverse immediately after the startup of the prime mover.

Further with this arrangement, even if, due to some cause, the prime mover is started up in a state where the reverse gate operator is being operated, the body is prevented from being driven in reverse immediately after the startup of the prime mover. Also with this arrangement, even if, due to some cause, the prime mover is started up in a state where the accelerator operator is being operated, the body is prevented from being driven forward immediately after the startup of the prime mover.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
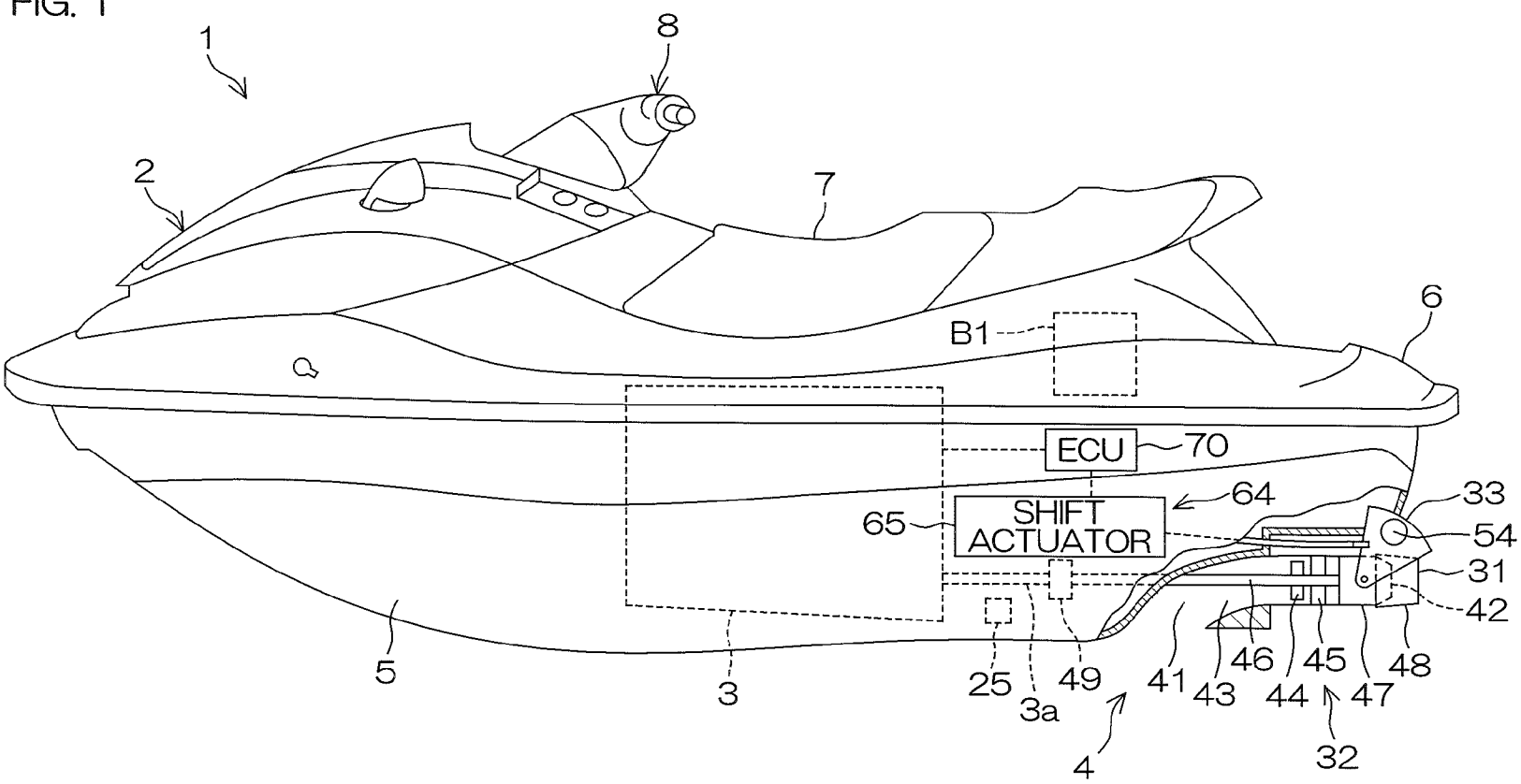
FIG. 1 is a schematic view of a jet propelled watercraft according to a preferred embodiment of the present invention.

FIG. 1 is a schematic view of a jet propelled watercraft according to a preferred embodiment of the present invention. The jet propelled watercraft 1 is a small vessel used to travel on a body of water, such as a lake or sea, etc. The jet propelled watercraft 1 according to the present preferred embodiment is a personal watercraft (PWC), for example.

The jet propelled watercraft 1 includes a body 2, an engine 3 as a prime mover disposed in an interior of the body 2, and a jet propulsion device 4 mounted on a rear portion of the body 2. The engine 3 and the jet propulsion device 4 constitute a propulsion generator that applies a propulsive force to the body 2.

The body 2 includes a hull 5 that defines a watercraft bottom and a deck 6 disposed above the hull 5. The engine 3 is disposed in a space defined between the hull 5 and the deck 6. Further in the space is disposed a battery B1 that supplies electric power to electrical equipment included in the jet propelled watercraft 1. The engine 3 is disposed in front of the jet propulsion device 4.

The engine 3 is an internal combustion engine that includes a crankshaft 3*a* rotatable around a rotation axis extending in a front/rear direction. The engine 3 includes an engine speed sensor 25 configured to detect a rotational speed of the engine 3. The jet propulsion device 4 is driven by the engine 3. The jet propulsion device 4 jets water, sucked into a watercraft interior (into the interior of the body 2) from the watercraft bottom, to a watercraft exterior (exterior of the body 2) to generate the propulsive force to propel the jet propelled watercraft 1 forward or in reverse.

A seat 7, on which an operator sits, is disposed on the deck 6. The seat 7 is disposed above the engine 3. The seat 7 is disposed at a center in a width direction of the jet propelled watercraft 1. A handle 8 is disposed in front of the seat 7. The handle 8 is an operating member operated by the operator to change a direction of the body 2.

Figure 2:
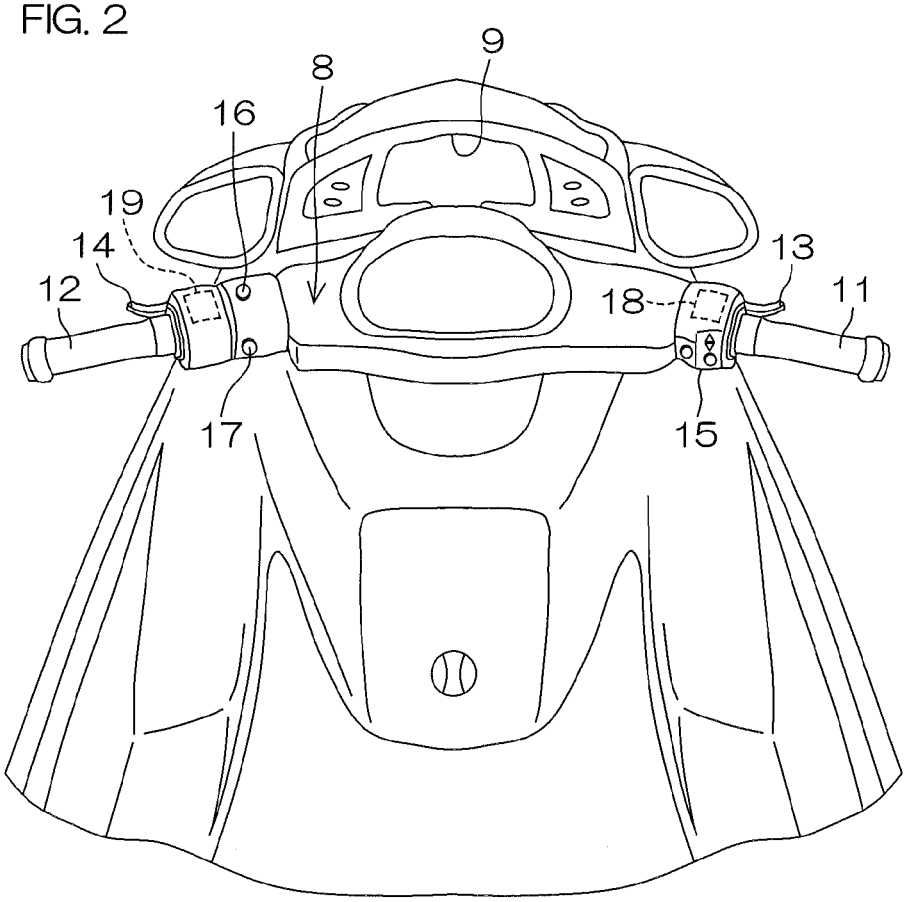
FIG. 2 is a perspective view of the arrangement of a vicinity of a handle of the jet propelled watercraft.

FIG. 2 is a perspective view of the arrangement of a vicinity of the handle 8. A display 9 is disposed in front of the handle 8. The handle 8 includes a right grip 11 and a left grip 12. A first accelerator operator (accelerator operator) 13 is rotatably mounted on the right grip 11. A second accelerator operator (reverse gate operator) 14 is rotatably mounted on the left grip 12. On the handle 8, an operation box 15 is mounted at an inner side of the right grip 11. A start switch 16 to start the engine and a stop switch 17 to stop the engine are provided at an inner side of the left grip 12 of the handle 8.

The first accelerator operator 13 is mainly operated to drive the jet propelled watercraft 1 forward. In the present preferred embodiment, the first accelerator operator 13 preferably is a lever type that includes an accelerator lever. An amount of operation of the first accelerator operator 13 (operation angle of the accelerator lever; hereinafter referred to as the "first accelerator operation amount Am1") is detected by a first accelerator position sensor 18. The first accelerator position sensor 18 is, for example, a potentiometer. The first accelerator position sensor 18 is an example of an accelerator operation detector that detects an operation state of the first accelerator operator 13.

The second accelerator operator 14 is mainly operated to drive the jet propelled watercraft 1 in reverse or to reduce a forward speed of the jet propelled watercraft 1. In the present preferred embodiment, the second accelerator operator 14 preferably is a lever type that includes a reverse lever. An amount of operation of the second accelerator operator 14 (operation angle of the reverse lever; hereinafter referred to as the "second accelerator operation amount Am2") is detected by a second accelerator position sensor 19. The second accelerator position sensor 19 is, for example, a potentiometer. The second accelerator position sensor 19 is an example of a reverse gate operation detector that detects an operation state of the second accelerator operator 14.

Figure 3:
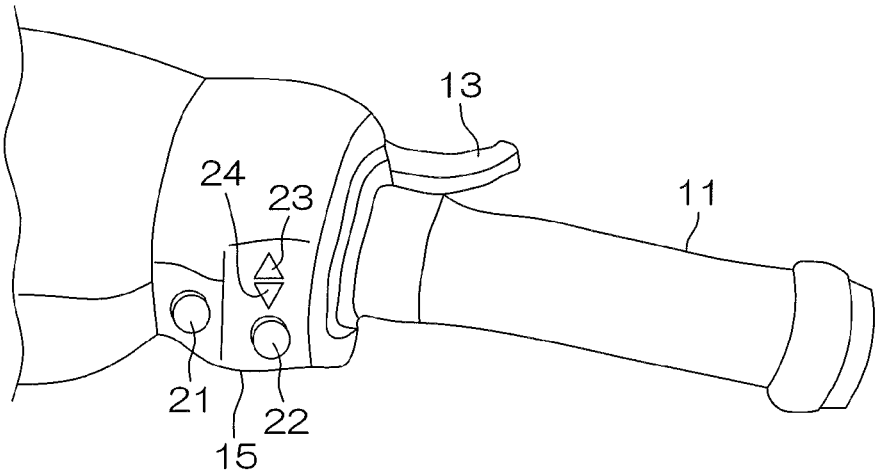
FIG. 3 is an enlarged perspective view of the arrangement of a vicinity of a right grip of the handle.

FIG. 3 is an enlarged perspective view of the arrangement of a vicinity of the right grip of the handle. A low-speed travel mode switch 21, a constant-speed travel mode switch 22, an acceleration fine adjustment switch 23, and a deceleration fine adjustment switch 24 are provided in the operation box 15. The switches 21 to 24 are disposed in a region enabling operation with a right thumb of the operator in a state where he/she holds the right grip 11 with the right hand.

The jet propelled watercraft 1 can be made to travel in any of a plurality of travel modes. The plurality of travel modes include an ordinary travel mode, a low-speed travel mode, and a constant-speed travel mode, for example. The ordinary travel mode is a travel mode (first mode) in which the jet propelled watercraft 1 travels at a speed that is in accordance with operations of the first accelerator operator 13 and the second accelerator operator 14. The low-speed travel mode is a mode (second mode) in which the jet propelled watercraft 1 travels at a predetermined low speed. The constant-speed travel mode is a mode in which the jet propelled watercraft 1 travels at the speed at the point at which the constant-speed travel mode switch 22 is operated.

The low-speed travel mode switch 21 is a switch configured to set the travel mode to the low-speed travel mode and is an example of a mode switching signal output that outputs a mode switching signal to switch from the ordinary travel mode to the low-speed travel mode. The fine adjustment switches 23 and 24 are switches configured to finely adjust the speed of the jet propelled watercraft 1 in the low-speed travel mode. The constant-speed travel mode switch 22 is a switch configured to set the travel mode to the constant-speed travel mode.

As shown in FIG. 1, the jet propulsion device 4 includes a jet pump 32, by which water of the watercraft exterior that is sucked in from the watercraft bottom is jetted rearward, and a reverse gate 33, which changes a direction of a jet flow jetted from the jet pump 32.

The jet pump 32 includes an intake 41 through which the watercraft exterior water is sucked in, an outlet 42 from which the water sucked in from the intake 41 is jetted rearward, and a flow passage 43 guiding the water sucked into the intake 41 to the outlet 42. The jet pump 32 further includes an impeller 44 (rotor vane) and a stator vane 45 that are disposed in the flow passage 43, a driveshaft 46 coupled to the impeller 44, a nozzle 47 defining the outlet 42, and a deflector 48 inclining the direction of the jet flow, jetted rearward from the nozzle 47, to the right and left.

The intake 41 is opened at the watercraft bottom and the outlet 42 is opened rearward further to the rear than the intake 41. The driveshaft 46 extends in the front/rear direction. A front end portion of the driveshaft 46 is disposed inside the watercraft and a rear end portion of the driveshaft 46 is disposed in the flow passage 43. The front end portion of the driveshaft 46 is coupled to the crankshaft 3*a* of the engine 3 via a coupling 49. The impeller 44 is coupled to the driveshaft 46. The stator vane 45 is disposed rearward of the impeller 44. The nozzle 47 is disposed rearward of the stator vane 45. The impeller 44 is rotatable around a central axis of the driveshaft 46 with respect to the flow passage 43. The stator vane 45 is fixed with respect to the flow passage 43. The nozzle 47 is fixed to the body 2.

The engine 3 drives the impeller 44, together with the driveshaft 46, around the central axis of the driveshaft 46. When the impeller 44 is driven to rotate, water is sucked into the flow passage 43 from the intake 41 and the water sucked into the flow passage 43 is fed from the impeller 44 to the stator vane 45. By the water fed by the impeller 44 passing through the stator vane 45, torsion of water flow generated by rotation of the impeller 44 is reduced and the water flow is straightened. The flow-straightened water is thus fed from the stator vane 45 to the nozzle 47. The nozzle 47 has a tubular form extending in the front/rear direction and the outlet 42 is formed by a rear end portion of the nozzle 47. The water fed to the nozzle 47 is thus jetted rearward from the rear end portion of the nozzle 47.

Figure 4:
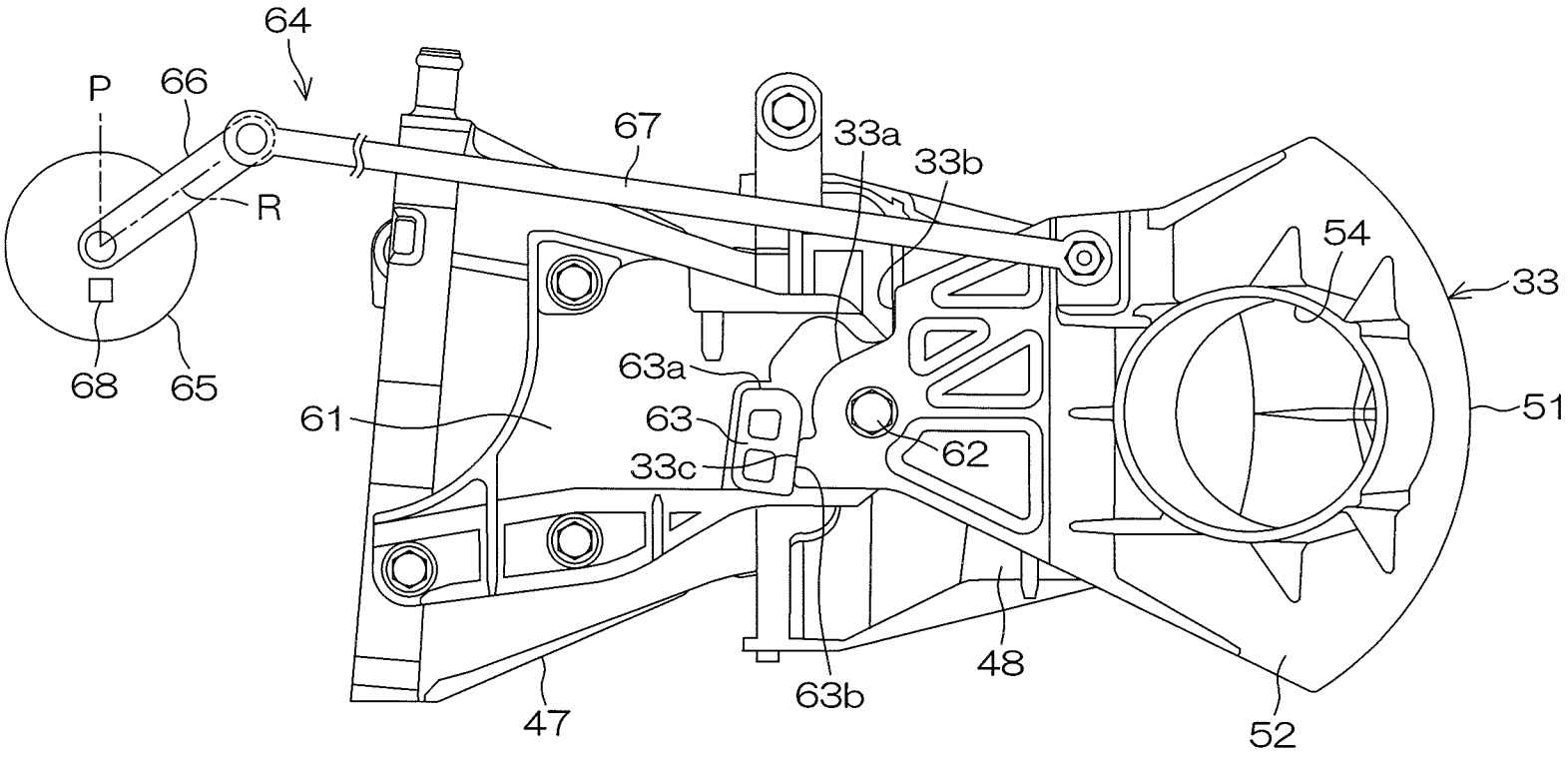
FIG. 4 is a schematic side view of the jet propelled watercraft in a state where a reverse gate is at a reverse drive position.
Figure 5:
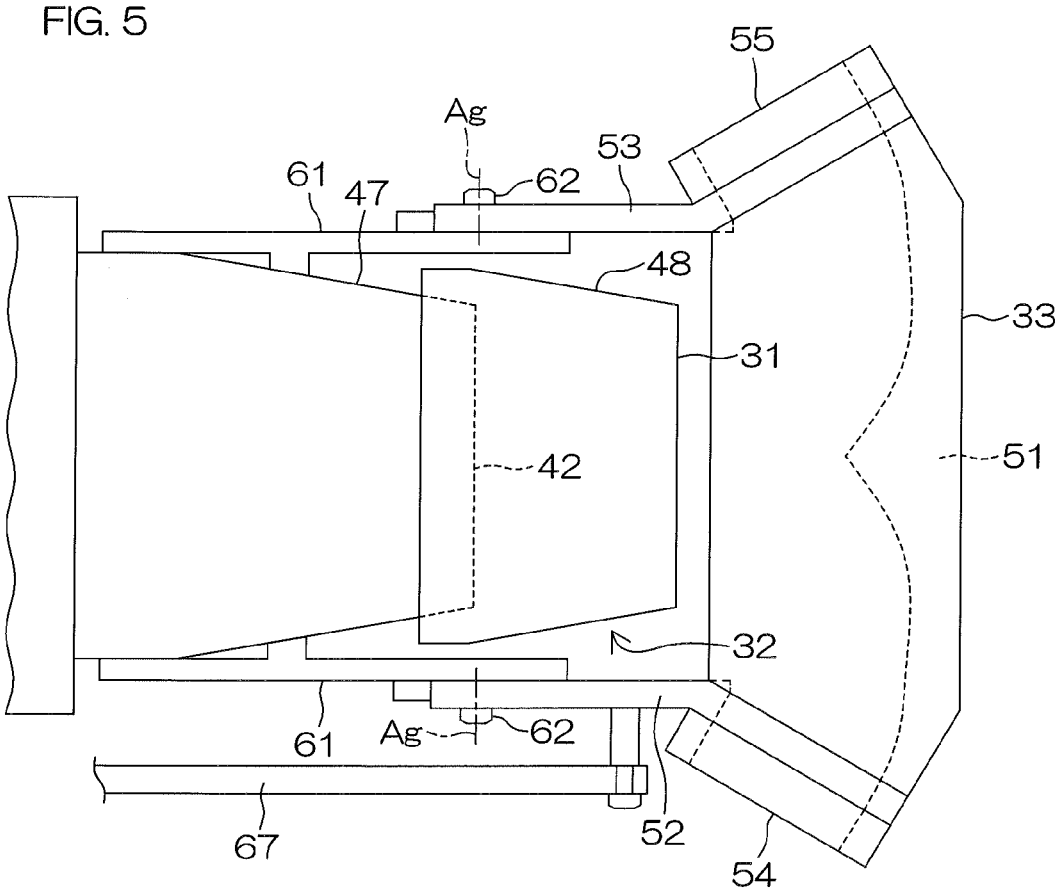
FIG. 5 is a schematic plan view of the arrangement of FIG. 4.

FIG. 4 is a schematic side view showing the arrangement of a vicinity of the nozzle 47 in enlarged manner. FIG. 5 is a schematic plan view of the arrangement of FIG. 4. The deflector 48 is disposed rearward of the nozzle 47. The deflector 48 is supported by the nozzle 47 in a manner enabling rotation in a right/left direction. The deflector 48 has a hollow tube shape. The outlet 42 of the nozzle 47 is disposed inside the deflector 48. The deflector 48 defines a jet port 31 that is opened rearward. The jet port 31 is disposed rearward of the outlet 42. The water that is jetted rearward from the nozzle 47 passes through an interior of the deflector 48 and is jetted from the jet port 31. A jetting direction of the water is in accordance with a right/left direction angle of the deflector 48.

The reverse gate 33 is supported by the nozzle 47 in a manner enabling rotation around an up/down rotation axis Ag extending in the right/left direction. For the sake of description, in the following, front, rear, up, and down with respect to the reverse gate 33 shall refer to front, rear, up, and down as defined in a state where the reverse gate 33 is at the position shown in FIG. 4 and FIG. 5. The reverse gate 33 includes a rear wall 51 as an opening/closing portion that opens/closes the jet port 31 of the deflector 48, a left side wall 52 extending frontward from a left side portion of the rear wall 51, and a right side wall 53 extending frontward from a right side portion of the rear wall 51. The left side wall 52 and the right side wall 53 have fan shapes spreading toward the rear in side view. A left opening 54 that is opened obliquely forward to the left is located near a rear end of the left side wall 52. A right opening 55 that is opened obliquely forward to the right is located near a rear end of the right side wall 53. The left opening 54 and the right opening 55 are right/left symmetrical to a vertical plane passing through a right/left center of the reverse gate 33.

A pair of right and left support brackets 61 are mounted to the nozzle 47. Front end portions of the respective side walls 52 and 53 of the reverse gate 33 are supported by the support brackets 61 via bolts 62, for example. The bolts 62 are inserted through the side walls 52 and 53 of the reverse gate 33 and screwed to the support brackets 61. The bolts 62 are respectively disposed along the up/down rotation axis Ag and at the right and left of the nozzle 47. The reverse gate 33 is thus enabled to rotate around the up/down rotation axis Ag with respect to the nozzle 47.

The front end portions of the respective side walls 52 and 53 include curved end surfaces 33*a* including portions that are arcuate-shaped around the up/down rotation axis Ag. The front end portions of the respective side walls 52 and 53 further include first rectilinear end surfaces 33*b* connected to upper ends of the curved end surfaces 33*a* and extending substantially upward and second rectilinear end surfaces 33*c* connected to lower ends of the curved end surfaces 33*a* and extending substantially downward.

Figure 6:
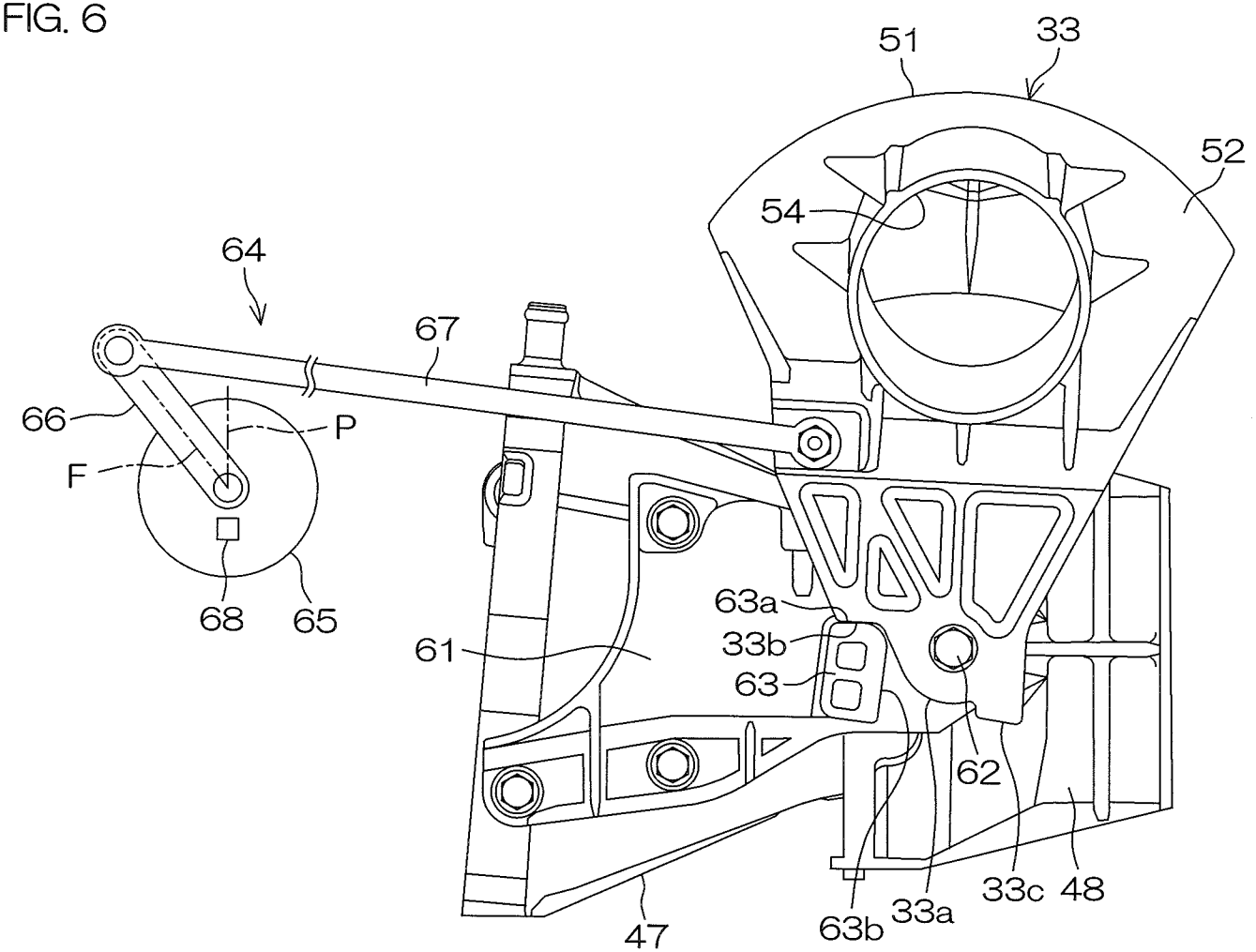
FIG. 6 is a schematic side view of the jet propelled watercraft in a state where the reverse gate is at a forward drive position.
Figure 7:
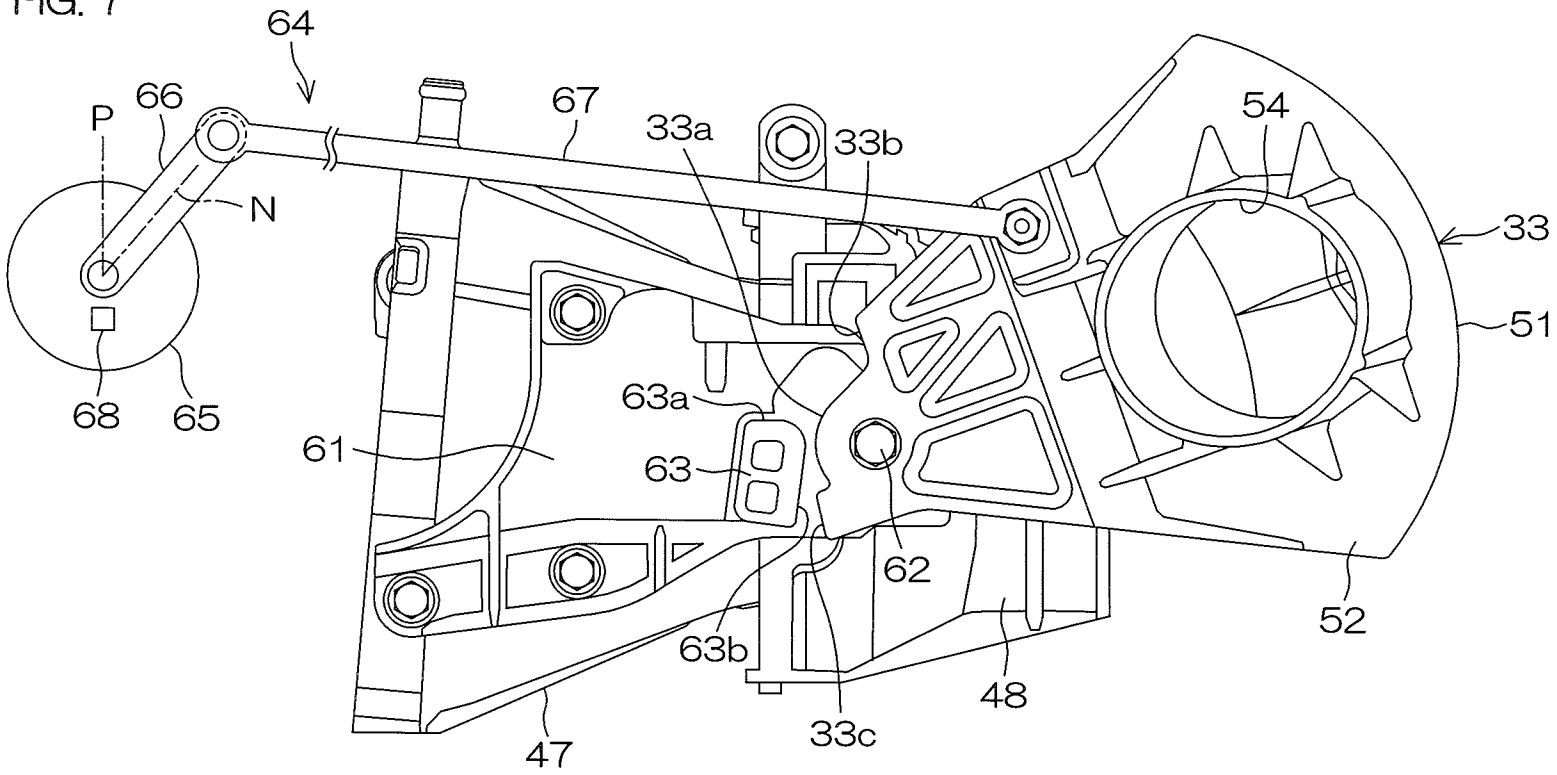
FIG. 7 is a schematic side view of the jet propelled watercraft in a state where the reverse gate is at a neutral position.

The reverse gate 33 is capable of moving to a reverse drive position shown in FIG. 4 and FIG. 5, a forward drive position shown in FIG. 6, and a neutral position shown in FIG. 7 by rotating around the up/down rotation axis Ag. The forward drive position is a position at which the jet port 31 is not covered at all by the rear wall 51 of the reverse gate 33 in a rear view viewed along the jetting direction of the water jetted from the jet port 31 of the deflector 48. The reverse drive position is a position at which the entire jet port 31 of the deflector 48 is covered by the rear wall 51 of the reverse gate 33 in the rear view. The neutral position is a predetermined position between the forward drive position and the reverse drive position and is a position at which a portion of the jet port 31 of the deflector 48 is covered by the rear wall 51 of the reverse gate 33 in the rear view.

In the state where the reverse gate 33 is disposed at the forward drive position (see FIG. 6), the jet port 31 of the deflector 48 is not covered by the reverse gate 33 and therefore the water jetted rearward from the outlet 42 of the nozzle 47 thus passes through the interior of the deflector 48 and is jetted rearward from the jet port 31. A thrust in a forward drive direction that drives the body 2 forward is thus generated.

In the state where the reverse gate 33 is disposed at the reverse drive position (see FIG. 4), the entire jet port 31 of the deflector 48 is covered by the reverse gate 33. The water jetted rearward from the jet port 31 thus collides against an inner surface of the reverse gate 33 and is thereafter jetted obliquely forward to the left and obliquely forward to the right from the left opening 54 and the right opening 55. The reverse gate 33 thus changes the direction of the water, jetted rearward from the jet port 31, toward the front. A thrust in a reverse drive direction that drives the body 2 in reverse is thus generated.

When the reverse gate 33 is disposed at the neutral position (see FIG. 7), a portion of the jet port 31 of the deflector 48 is covered by the reverse gate 33. Therefore, while a portion of the water jetted from the jet port 31 is jetted rearward, another portion of the water jetted from the jet port 31 is jetted obliquely forward to the left and obliquely forward to the right from the left opening 54 and the right opening 55. A thrust in the forward drive direction and a thrust in the reverse drive direction are thus generated. The neutral position is set, for example, at a position at which the forward drive direction thrust and the reverse drive direction thrust are equal or substantially equal.

Each support bracket 61 is provided with a stopper 63 which the reverse gate 33 is pressed against at the forward drive position (see FIG. 6) and the reverse drive position (see FIG. 4). The stopper 63 has a rectangular or substantially rectangular plate shape that is long in the up/down direction in side view. An upper end surface of the stopper 63 is a first stopper surface 63*a* and a rear end surface of the stopper is a second stopper surface 63*b*.

As shown in FIG. 6, when the reverse gate 33 is at the forward drive position, the first rectilinear end surfaces 33*b* of the respective side walls 52 and 53 of the reverse gate 33 are pressed against the first stopper surfaces 63*a* of the stoppers 63. As shown in FIG. 4 and FIG. 5, when the reverse gate 33 is at the reverse drive position, the second rectilinear end surfaces 33*c* of the respective side walls 52 and 53 of the reverse gate 33 are pressed against the second stopper surfaces 63*b* of the stoppers 63. As shown in FIG. 7, when the reverse gate 33 is at the neutral position, the reverse gate 33 is not pressed against the stoppers 63.

The jet propelled watercraft 1 includes a deflector moving mechanism (not shown) that rotates the deflector 48 to the right or left in accordance with an operation amount (steering angle) of the handle 8. The deflector moving mechanism mechanically couples the handle 8 and the deflector 48. The deflector moving mechanism includes, for example, a push-pull cable that transmits an actuation of the handle 8 to the deflector 48. The deflector moving mechanism may be an electrically driven moving mechanism that includes an electric motor, for example. A straight drive position of the handle 8 is associated with a straight drive position of the deflector 48. When the handle 8 is operated, the deflector 48 is rotated to the left or to the right by the deflector moving mechanism. The jetting direction of the water from the jet port 31 is thus changed to the right or left.

The jet propelled watercraft 1 further includes a reverse gate moving mechanism 64 (see FIG. 1, FIG. 4, FIG. 6, and FIG. 7) that rotates the reverse gate 33 up and down based on operation of the first accelerator operator 13 and the second accelerator operator 14. In the present preferred embodiment, the reverse gate moving mechanism 64 includes a shift actuator 65, a shift arm 66 rotated by the shift actuator 65, and a link 67 coupling the shift arm 66 and the reverse gate 33. In the present preferred embodiment, the shift actuator 65 preferably is an electric motor, for example.

The link 67 is pushed or pulled when the shift arm 66 is rotated by the shift actuator 65. The reverse gate 33 is thus rotated around the up/down rotation axis Ag. A shift position of the reverse gate 33 (hereinafter referred to simply as the "shift position") is detected by a shift position sensor 68. The shift position sensor 68 is an example of a shift position detector or a shift state detector that detects the shift position or a shift state. In the present preferred embodiment, the shift position sensor 68 preferably is a potentiometer that detects a rotation angle (rotation amount) of the shift arm 66 from a reference position set in advance.

Figure 8:
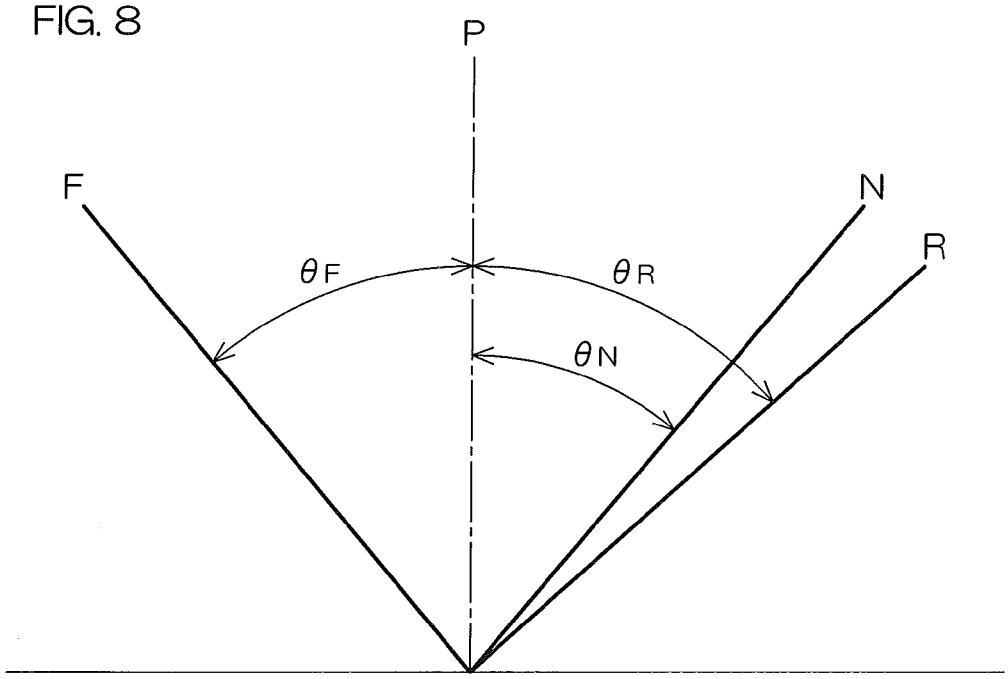
FIG. 8 is a schematic view of rotation angle positions of a shift arm at a forward drive position, a neutral position, and a reverse drive position.

FIG. 8 is a schematic view of rotation angle positions of the shift arm 66 at the forward drive position, the neutral position, and the reverse drive position. In the present preferred embodiment, the reference position P of the shift arm 66 is a position at which the shift arm 66 is perpendicular or substantially perpendicular to a horizontal plane of the body 2. A position F, at which the shift arm 66 is rotated in a counter-clockwise direction by just a predetermined angle $\theta_F$ from the reference position P, indicates the rotation angle position of the shift arm 66 corresponding to the forward drive position of the reverse gate 33. A position R, at which the shift arm 66 is rotated in a clockwise direction by just a predetermined angle $\theta_R$ from the reference position P, indicates the rotation angle position of the shift arm 66 corresponding to the reverse drive position of the reverse gate 33. A position N, at which the shift arm 66 is rotated in the clockwise direction by just a predetermined angle $\theta_N$ from the reference position P, indicates the rotation angle position of the shift arm 66 corresponding to the neutral position of the reverse gate 33.

Figure 9:
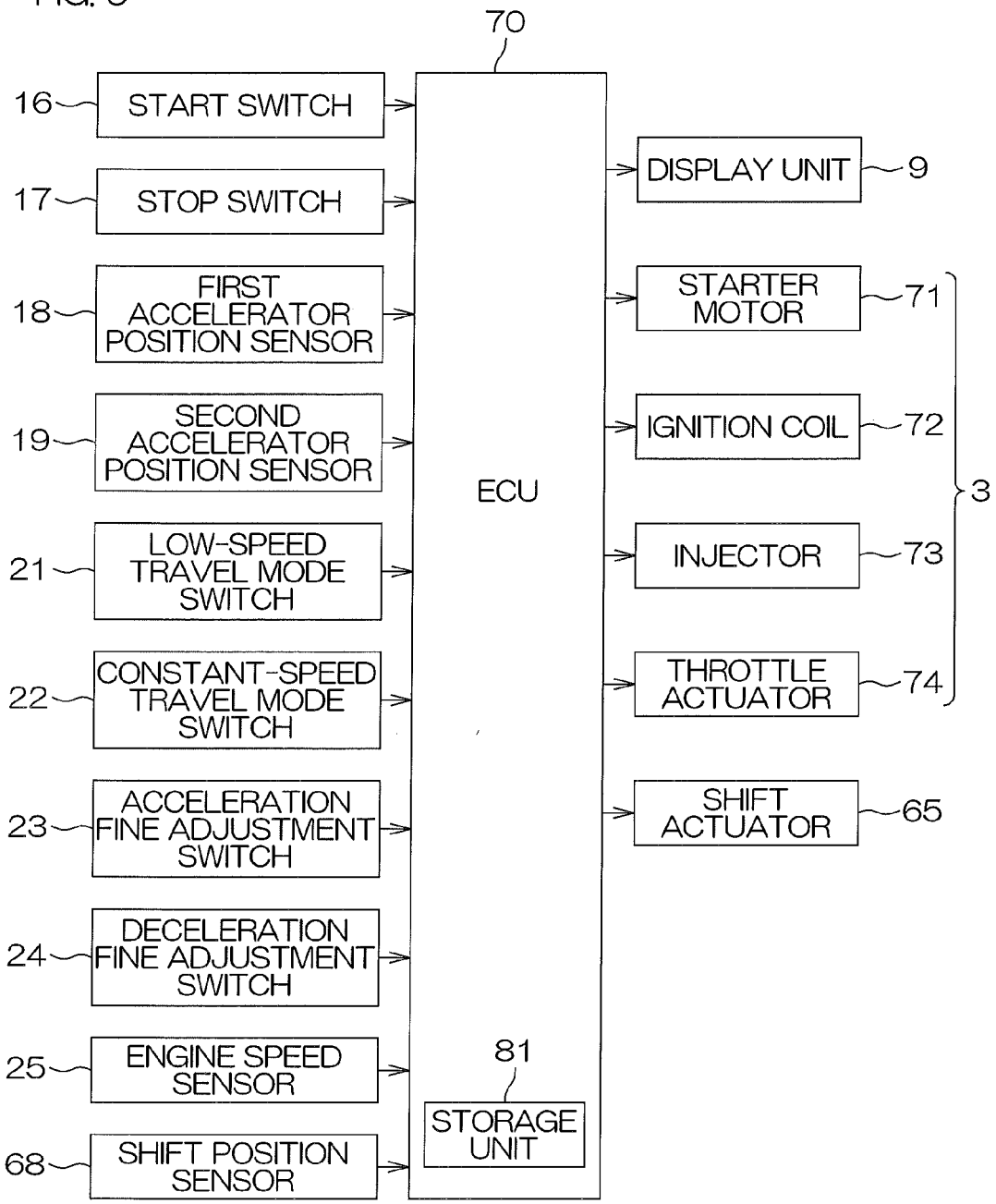
FIG. 9 is a block diagram for describing the electrical arrangement of the jet propelled watercraft.

FIG. 9 is a block diagram for describing the electrical configuration of the jet propelled watercraft 1. The engine 3, the shift actuator 65, the display 9, etc., are controlled by an ECU 70 (electronic controller) the defines a controller. The engine 3 includes a starter motor 71, an ignition coil 72, an injector 73, and a throttle actuator 74.

Switches, including the start switch 16, the stop switch 17, the low-speed travel mode switch 21, the constant-speed travel mode switch 22, the acceleration fine adjustment switch 23, and the deceleration fine adjustment switch 24, are connected to the ECU 70. Further, sensors, including the first accelerator position sensor 18, the second accelerator position sensor 19, the engine speed sensor 25, and the shift position sensor 68, are connected to the ECU 70.

Further, the display 9, and actuators, such as the starter motor 71, the ignition coil 72, the injector 73, the throttle actuator 74, the shift actuator 65, etc., are connected to the ECU 70. The starter motor 71 is configured to perform cranking of the engine 3. The injector 73 is configured to inject fuel into an air intake path of the engine 3. The throttle actuator 74 is configured to drive a throttle valve (not shown) of the engine 3 to adjust an amount of air supplied to the air intake path of the engine 3. The ignition coil 72 is configured to raise a voltage applied to a spark plug (not shown).

The ECU 70 includes a microcomputer (not shown) and a storage device such as a memory 81 storing a program thereof, etc. The ECU 70 further includes drive circuits (not shown) of the starter motor 71, the throttle actuator 74, and the shift actuator 65. Information expressing the angles $\theta_F$, $\theta_R$, and $\theta_N$ shown in FIG. 8 are stored in the storage device 81.

The ECU 70 calculates a first throttle opening degree Θ1 corresponding to the first accelerator operation amount Am1 detected by the first accelerator position sensor 18. The ECU 70 further calculates a second throttle opening degree Θ2 corresponding to the second accelerator operation amount Am2 detected by the second accelerator position sensor 19.

Figure 10A:
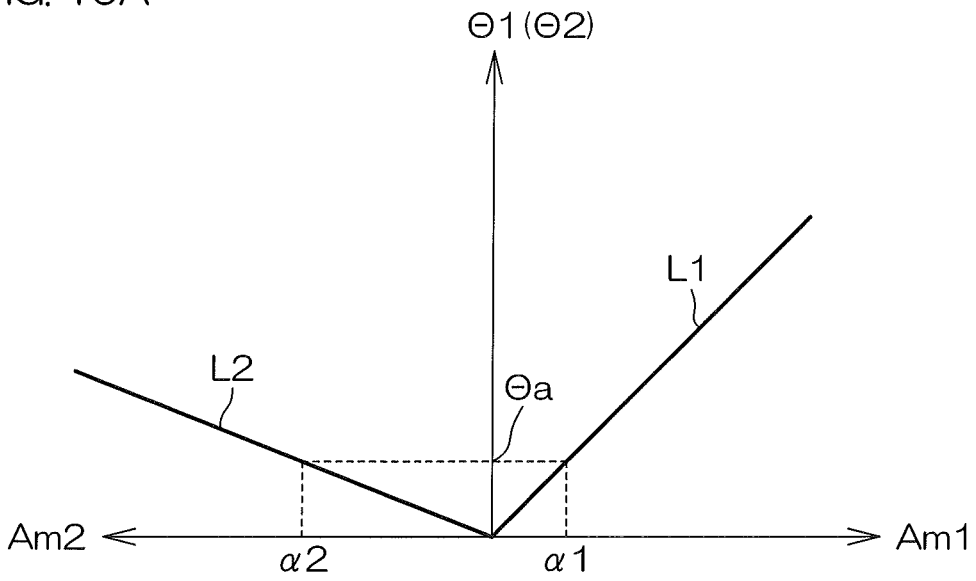
FIG. 10A is a characteristics diagram of a setting example of a throttle opening degree with respect to an accelerator operation amount.

A straight line L1 in FIG. 10A indicates a setting example of the first throttle opening degree Θ1 with respect to the first accelerator operation amount Am1. A straight line L2 in FIG. 10A indicates a setting example of the second throttle opening degree Θ2 with respect to the second accelerator operation amount Am2. The first throttle opening degree Θ1 is set so as to increase linearly as the first accelerator operation amount Am1 increases. Similarly, the second throttle opening degree Θ2 is set so as to increase linearly as the second accelerator operation amount Am2 increases. However, with the present preferred embodiment, a rate of change of the second throttle opening degree Θ2 with respect to the second accelerator operation amount Am2 (slope of the straight line L2) is smaller than a rate of change of the first throttle opening degree Θ1 with respect to the first accelerator operation amount Am1 (slope of the straight line L1). Therefore, when the first accelerator operation amount Am1 and the second accelerator operation amount Am2 are of the same value, the second throttle opening degree Θ2 is less than the first throttle opening degree Θ1.

In the ordinary travel mode, the ECU 70 performs an ordinary rotational speed control process and an ordinary shift control process. In the ordinary rotational speed control process, the ECU 70 controls the throttle actuator 74 in accordance with the first throttle opening degree Θ1 and the second throttle opening degree Θ2 to control the engine speed. Specifically, when the shift position is the forward drive position, the ECU 70 controls the throttle opening degree, for example, in accordance with a difference between the first throttle opening degree Θ1 and the second throttle opening degree Θ2 (hereinafter referred to as the "throttle opening degree difference (Θ1−Θ2)"). When the shift position is the reverse drive position or the neutral position, the ECU 70 controls the throttle opening degree, for example in accordance with the throttle opening degree Θ2.

The ECU 70 may perform the ordinary rotational speed control process by the same method as a rotational speed control method disclosed in United States Patent Application Publication No. 2013/0344754. The entire contents of US Patent Application Publication No. 2013/0344754 are incorporated herein by reference.

In the ordinary shift control process, the ECU 70 controls the shift actuator 65 in accordance with the first throttle opening degree Θ1, the second throttle opening degree Θ2, and the engine speed V detected by the engine speed sensor 25 to control the shift position.

When for example, in a case where the shift position is the forward drive position, the throttle opening degree difference (Θ1−Θ2) is less than a predetermined value, the second accelerator operator 14 is operated, and the engine speed V is greater than a predetermined speed, the ECU 70 switches the shift position to the neutral position. Specifically, the ECU 70 sets a target shift position to the neutral position and thereafter controls the shift actuator 65 to move the reverse gate 33 to the target shift position. The most recent target shift position is held in the storage 81. The ECU 70 judges whether or not the reverse gate 33 has reached the target shift position. Specifically, the ECU 70 judges whether or not the rotation angle detected by the shift position sensor 68 has become equal to the angle, among the angles $\theta_F$, $\theta_R$ and $\theta_N$ stored in the storage 81, corresponding to the target shift position.

When for example, in a case where the shift position is the forward drive position, the throttle opening degree difference (Θ1−Θ2) is less than the predetermined value, the second accelerator operator 14 is operated, and the engine speed V is not more than the predetermined speed, the ECU 70 switches the shift position to the reverse drive position. Specifically, the ECU 70 sets the target shift position to the reverse drive position and thereafter controls the shift actuator 65 to move the reverse gate 33 to the target shift position.

When for example, in a case where the shift position is the neutral position, the engine speed V is less than the predetermined speed and the second accelerator operator 14 is operated, the ECU 70 switches the shift position to the reverse drive position. Specifically, the ECU 70 sets the target shift position to the reverse drive position and thereafter controls the shift actuator 65 to move the reverse gate 33 to the target shift position.

When for example, in a case where the shift position is the neutral position, the engine speed V is less than the predetermined speed, the second accelerator operator 14 is not operated, and the first accelerator operator 13 is operated, the ECU 70 switches the shift position to the forward drive position. Specifically, the ECU 70 sets the target shift position to the forward drive position and thereafter controls the shift actuator 65 to move the reverse gate 33 to the target shift position.

When for example, in a case where the shift position is the reverse drive position, the second accelerator operator 14 is not operated and the first accelerator operator 13 is operated, the ECU 70 switches the shift position to the forward drive position. Specifically, the ECU 70 sets the target shift position to the forward drive position and thereafter controls the shift actuator 65 to move the reverse gate 33 to the target shift position.

When for example, in a case where the shift position is the reverse drive position, a state where the second accelerator operator 14 and the first accelerator operator 13 are not operated is sustained for not less than a predetermined time, the ECU 70 switches the shift position to the neutral position. Specifically, the ECU 70 sets the target shift position to the neutral position and thereafter controls the shift actuator 65 to move the reverse gate 33 to the target shift position.

The reverse gate 33 is thus controlled in position in accordance with the operation of the second accelerator operator 14. That is, the second accelerator operator 14 and the second accelerator position sensor 19 that detects the operation amount thereof constitute a shift switching signal output that outputs a shift switching signal.

The ECU 70 may perform the ordinary shift control process by the same method as a shift control method disclosed in United States Patent Application Publication No. 2013/0344754.

Figure 11:
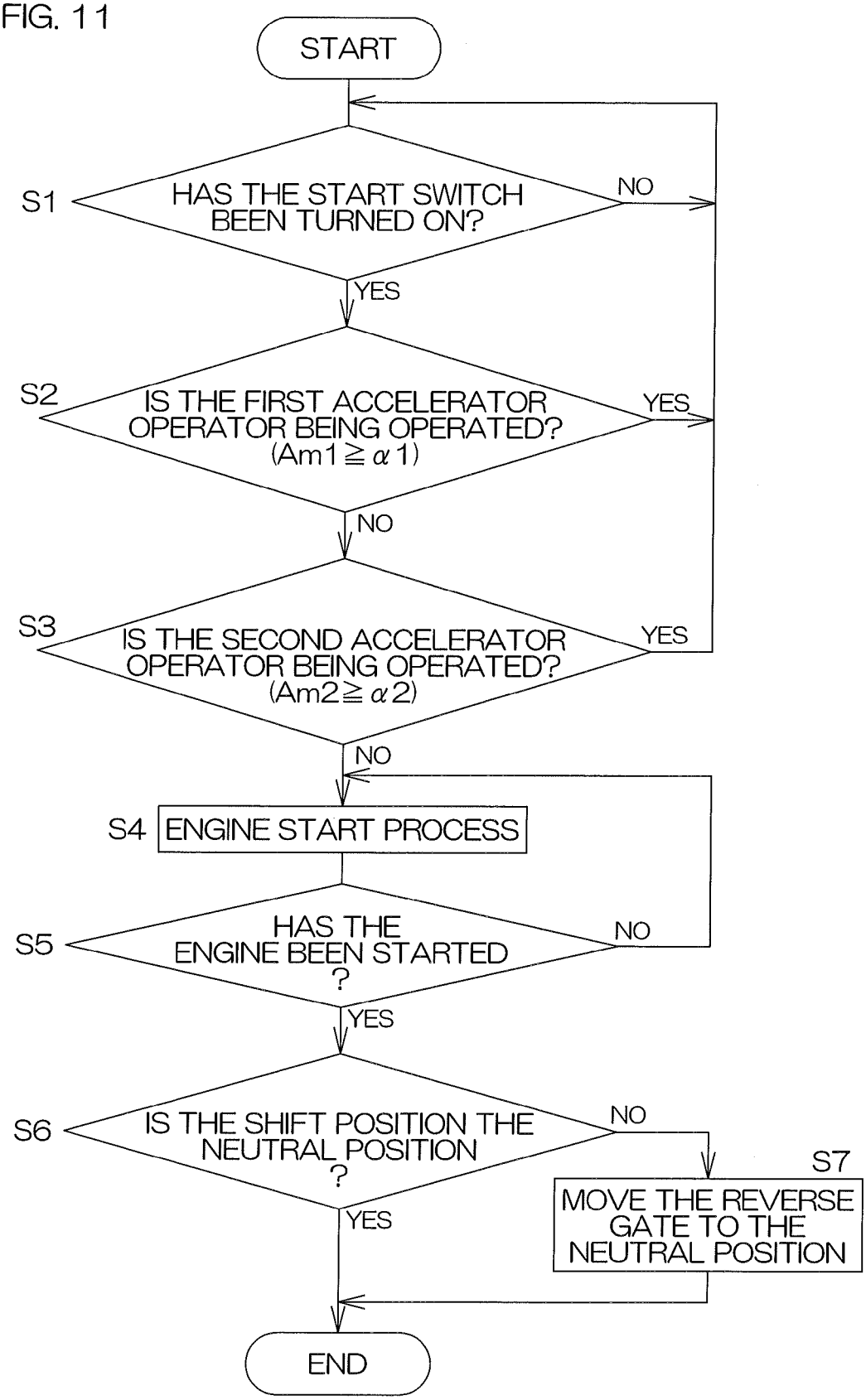
FIG. 11 is a flowchart of a procedure of an example of an engine start control process executed by an ECU.

FIG. 11 is a flowchart of a procedure of an example of an engine start control process executed by the ECU 70.

The ECU 70 determines whether or not the start switch 16 has been turned on in a state where the engine is stopped (step S1). If the start switch 16 has not been turned on (step S1: NO), the ECU 70 returns to step S1.

If in step S1, it is determined that the start switch 16 has been turned on (step S1: YES), the ECU 70 determines whether or not the first accelerator operator 13 is being operated (step S2). Specifically, the ECU 70 determines whether or not the first accelerator operation amount Am1 detected by the first accelerator position sensor 18 is not less than a first threshold α1. The ECU 70 determines that the first accelerator operator 13 is being operated if the first accelerator operation amount Am1 is not less than the first threshold al, and determines that the first accelerator operator 13 is not being operated if the first accelerator operation amount Am1 is less than the first threshold α1.

If it is determined that the first accelerator operator 13 is not being operated (step S2: NO), the ECU 70 determines whether or not the second accelerator operator 14 is being operated (step S3). Specifically, the ECU 70 determines whether or not the second accelerator operation amount Am2 detected by the second accelerator position sensor 19 is not less than a second threshold α2. The ECU 70 determines that the second accelerator operator 14 is being operated if the second accelerator operation amount Am2 is not less than the second threshold α2, and determines that the second accelerator operator 14 is not being operated if the second accelerator operation amount Am2 is less than the second threshold α2.

With the present preferred embodiment, the second threshold α2 is set to a value greater than the first threshold α1 as shown in FIG. 10A. Also with the present preferred embodiment, the first threshold α1 and the second threshold α2 are set so that a first throttle opening degree Θ1 corresponding to the first threshold α1 and a second throttle opening degree Θ2 corresponding to the second threshold α2 are of equal value (Θa). That is, the engine speed corresponding to the first threshold α1 and the engine speed corresponding to the second threshold α2 are equal or substantially equal to each other.

If it is determined that the second accelerator operator 14 is not being operated (step S3: NO), the ECU 70 performs an engine starting process (step S4). Specifically, the ECU 70 drives the starter motor 71, the ignition coil 72, and the injector 73 and performs fuel supply control and ignition control to start the engine 3. The ECU 70 then determines whether or not the engine 3 has been started (step S5). Specifically, the ECU 70 determines the starting of the engine 3 based on whether or not the engine speed V detected by the engine speed sensor 25 is not less than a predetermined start determination threshold β1. That is, the ECU 70 determines that the engine 3 has been started if the engine speed V is not less than the start determination threshold β1 and determines that the engine 3 has not been started if the engine speed V is less than the start determination threshold β1. If it is determined that the engine 3 has not been started (step S5: NO), the ECU 70 returns to step S4 to perform the engine starting process.

If in step S5, it is determined that the engine 3 has been started (step S5: YES), the ECU 70 determines whether or not the shift position is the neutral position (step S6). If the shift position is other than the neutral position (step S6: NO), the ECU 70 sets the target shift position to the neutral position and thereafter controls the shift actuator 65 to move the reverse gate 33 to the neutral position (step S7). The ECU 70 then ends the engine start control process and starts control in the ordinary travel mode.

If in step S6, it is determined that the shift position is the neutral position (step S6: YES), the ECU 70 ends the engine start control process and starts control in the ordinary travel mode.

If in step S2, it is determined that the first accelerator operator 13 is being operated (step S2: YES), the ECU 70 returns to step S1. The ECU 70 also returns to step S1 if in step S3, it is determined that the second accelerator operator 14 is being operated (step S3: YES).

If it is determined that the first accelerator operator 13 is being operated in step S2 or it is determined that the second accelerator operator 14 is being operated in step S3, the ECU 70 may return to step S1 upon displaying an error on the display 9.

With the present preferred embodiment, even when the start switch 16 is turned on, the starting of the engine 3 is prohibited if it is determined that the first accelerator operator 13 is being operated (step S2). Driving of the body 2 forward by the moving of the reverse gate 33 to the forward drive position immediately after the starting of the engine is thus prevented. Further, the rotational speed of the engine 3 immediately after the starting of the engine is suppressed to a low speed and application of a large propulsive force to the body 2 immediately after the starting of the engine is avoided.

With the present preferred embodiment, it is determined that the first accelerator operator 13 is being operated when the first accelerator operation amount Am1 is not less than the first threshold $\alpha 1$. Whether or not the first accelerator operator 13 is being operated is thus determined appropriately, and accordingly, engine start prohibition when the first accelerator operator 13 is being operated is performed appropriately.

With the present preferred embodiment, the first accelerator operator 13 includes the accelerator lever. The first accelerator operation amount Am1 corresponds to the operation angle of the accelerator lever. The operation state of the accelerator lever is thus determined appropriately and start prohibition of the engine 3 during accelerator lever operation is performed appropriately. More specifically, the starting of the engine 3 is prohibited when the operation angle of the accelerator lever is not less than the predetermined threshold. The starting of the engine 3 is thus prohibited appropriately.

With the present preferred embodiment, even when the start switch 16 is turned on, the starting of the engine 3 is prohibited if it is determined that the second accelerator operator 14 is being operated (step S3). The driving of the body 2 in reverse by the moving of the reverse gate 33 to the reverse drive position immediately after engine start is thus prevented. Further, the rotational speed of the engine 3 is suppressed to be low immediately after engine start and application of a large propulsive force to the body 2 immediately after engine start is avoided.

With the present preferred embodiment, it is determined that the second accelerator operator 14 is being operated when the second accelerator operation amount Am2 is not less than the second threshold $\alpha 2$. Whether or not the second accelerator operator 14 is being operated is thus determined appropriately, and accordingly, engine start prohibition when the second accelerator operator 14 is being operated is performed appropriately.

With the present preferred embodiment, the second accelerator operator 14 includes the reverse lever. The second accelerator operation amount Am2 corresponds to the operation angle of the reverse lever. The operation state of the reverse lever is thus determined appropriately and start prohibition of the engine 3 during reverse lever operation is performed appropriately. More specifically, the starting of the engine 3 is prohibited when the operation angle of the reverse lever is not less than the predetermined threshold. The starting of the engine 3 is thus prohibited appropriately.

With the present preferred embodiment, the first throttle opening degree $\Theta 1$ corresponding to the first threshold $\alpha 1$ and the second throttle opening degree $\Theta 2$ corresponding to the second threshold $\alpha 2$ are equal or substantially equal. That is, the rotational speed of the engine 3 corresponding to the first threshold $\alpha 1$ and the rotational speed of the engine 3 corresponding to the second threshold $\alpha 2$ are equal. Operations of the first accelerator operator 13 and the second accelerator operator 14 are thus determined based on the rotational speed of the engine 3. The operations of the first accelerator operator 13 and the second accelerator operator 14 is thus determined from a standpoint of the magnitude of the propulsive force generated when the engine 3 is started. The start prohibition of the engine 3 is thus controlled more appropriately.

If, immediately after engine start, the shift position is determined to be other than the neutral position, the reverse gate 33 is moved to the neutral position (steps S6 and S7). The reverse gate 33 is thus moved to the neutral position immediately after engine start even if the shift position is at the forward drive position or the reverse drive position at engine start, and the body 2 is thus suppressed from being driven forward or in reverse immediately after engine start.

Even if, due to some cause, the engine 3 is started in a state where at least one of either the first accelerator operator 13 or the second accelerator operator 14 is being operated, the body 2 is suppressed from being driven forward or in reverse immediately after engine start. For example, if the first or second accelerator position sensor 18 or 19 is malfunctioning, the determination of step S2 or S3 will not be performed correctly and the engine 3 may thus be started in a state where at least one of either the first or second accelerator operator 13 or 14 is being operated. Even in such a case, the reverse gate 33 is moved to the neutral position immediately after engine start and therefore the driving of the body 2 forward or in reverse immediately after engine start is avoided.

When a shift control is performed in the state that a rotation speed of the engine 3 is high, resistance of the water to be applied to reverse gate 33 becomes big.

There is thus a possibility that a big load is applied to a shift actuator 65, or that the shift control is not performed normally.

If the shift control is permitted only when a rotation speed of the engine 3 is around an idling rotation speed, a responsiveness is deteriorated in at the time of the immediate acceleration after change from a reverse drive position to a forward drive position when the body is driven in reverse.

Therefore, ECU 70 may perform a speed limit control to limit a rotation speed of the engine 3 in a predetermined range during the shift control is being performed. For example, the predetermined range is set within the range of the rotation speed that is not less than the idling rotation speed and does not interfere with the shift control.

Although a preferred embodiment of the present invention has been described above, the present invention may be implemented in yet other preferred embodiments.

For example, with the preferred embodiments described above, the first threshold $\alpha 1$ and the second threshold $\alpha 2$ are preferably set so that the first throttle opening degree $\Theta 1$ corresponding to the first threshold $\alpha 1$ and the second throttle opening degree $\Theta 2$ corresponding to the second threshold $\alpha 2$ are of equal value ($\Theta$a). However, the first threshold $\alpha 1$ and the second threshold $\alpha 2$ may be set so that the first throttle opening degree $\Theta 1$ corresponding to the first threshold $\alpha 1$ and the second throttle opening degree $\Theta 2$ corresponding to the second threshold $\alpha 2$ take on different values. In this case, the engine speed that serves as a basis for determining operation differs between the first accelerator operator 13 and the second accelerator operator 14. The operations of the first accelerator operator 13 and the second accelerator operator 14 is thus determined from a standpoint of the respective magnitudes of the forward drive propulsive force and the reverse drive propulsive force generated when the engine 3 is started. The start prohibition of the engine 3 is thus controlled even more appropriately.

Figure 10B:
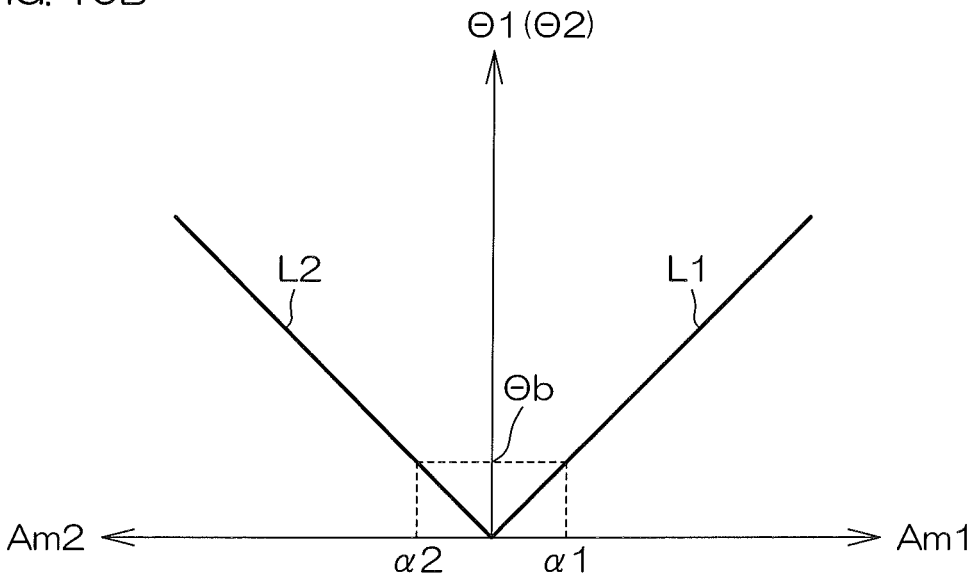
FIG. 10B is a characteristics diagram of another setting example of the throttle opening degree with respect to the accelerator operation amount.

Also, with the preferred embodiments described above, the rate of change of the second throttle opening degree $\Theta 2$ with respect to the second accelerator operation amount Am2 preferably is set to be smaller than the rate of change of the first throttle opening degree $\Theta 1$ with respect to the first accelerator operation amount Am1 as shown in FIG. 10A. However, as shown in FIG. 10B, the rate of change of the second throttle opening degree $\Theta 2$ with respect to the second accelerator operation amount Am2 (slope of the straight line L2 in FIG. 10B) may be set to be equal to the rate of change of the first throttle opening degree $\Theta 1$ with respect to the first accelerator operation amount Am1 (slope of the straight line L1 in FIG. 10B). In this case, the first threshold $\alpha 1$ and the second threshold $\alpha 2$ may be set to the same value as shown in FIG. 10B. When the first threshold al and the second threshold $\alpha 2$ are set to the same value, the first throttle opening degree $\Theta 1$ corresponding to the first threshold $\alpha 1$ and the second throttle opening degree $\Theta 2$ corresponding to the second threshold $\alpha 2$ take on the same value (8*b*).

With the preferred embodiments described above, in the ordinary travel mode, the ECU 70 performs the ordinary engine speed control process and the ordinary shift control process in accordance with the operation amount of the first accelerator operator 13, the operation amount of the second accelerator operator (reverse gate operator) 14, and the engine speed. However, in the ordinary travel mode, the ECU 70 may control the engine speed in accordance with the operation of the first accelerator operator 13 and perform shift control in accordance with the operation of the second accelerator operator 14. That is, the second accelerator operator 14 may be used just to switch the shift position.

Although with the preferred embodiments described above, the second accelerator operator 14 preferably is a lever type, it may instead be of a grip type or may be a toggle switch or a button switch. Also, although with the preferred embodiments described above, the first accelerator operator 13 preferably is a lever type, it may instead be of a grip type.

If the second accelerator operator 14 is a switch, such as a toggle switch or button switch, etc., the second accelerator operator 14 constitutes a reverse gate operation detector that outputs a reverse gate position command signal in accordance with the operation of the second accelerator operator 14. In this case, the ECU 70 determines that the second accelerator operator 14 is being operated when, for example, the reverse gate position signal is being output by the second accelerator operator 14. That is, whether or not the second accelerator operator 14 is being operated is determined based on whether or not the reverse gate position command signal is output. The starting of the engine 3 is thus prohibited under circumstances where there is a possibility for the reverse gate position to be changed in response to the position command signal. The starting of the engine 3 is thus prohibited appropriately.

With the preferred embodiments described above, the shift position of the reverse gate 33 preferably is detected by the shift position sensor 68 that detects the rotation angle of the shift arm 66. However, the shift position may be detected by a plurality of limit switches.

Although with the preferred embodiments described above, the shift actuator 65 preferably is an electric motor, a hydraulic actuator may be used instead.

Although with the preferred embodiments described above, the case where the prime mover preferably is the engine 3 was described, the prime mover may be an electric motor instead. In this case, the electric motor is started up as the prime mover in step S4 of FIG. 11. In step S5 of FIG. 11, it is judged whether or not the electric motor has been started up.

Although with the preferred embodiments described above, the engine 3, the shift actuator 65, the display 9, etc., preferably are controlled by a single ECU 70, these may be controlled by a plurality of ECUs instead.

Also, although with the preferred embodiments described above, the case where the jet propelled watercraft preferably is a personal watercraft was described, the present invention may be applied to a jet propelled watercraft of another form, such as a jet boat, a sport boat, etc.

The present application corresponds to Japanese Patent Application No. 2014-162715 filed on Aug. 8, 2014 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:

a body;

a prime mover;

a jet pump driven by the prime mover and jetting water from a jet port;

a reverse gate changing a direction of the jet flow jetted from the jet pump;

a shift actuator capable of moving the reverse gate to a plurality of shift positions including at least a forward drive position, at which the direction of the jet flow is toward a rear of the body, and a reverse drive position, at which the direction of the jet flow is toward a front of the body;

a reverse gate operator operated by an operator to set a position of the reverse gate;

a reverse gate operation detector detecting an operation state of the reverse gate operator; and a controller configured or programmed to determine, in accordance with the operation state of the reverse gate operator detected by the reverse gate operation detector, whether or not the reverse gate operator is being operated and to prohibit startup of the prime mover when it is determined that the reverse gate operator is being operated.

2. The jet propelled watercraft according to claim 1, wherein the reverse gate operation detector is configured to detect an operation amount of the reverse gate operator; and the controller is configured or programmed to determine that the reverse gate operator is being operated when the operation amount of the reverse gate operator detected by the reverse gate operation detector is not less than a predetermined threshold.

3. The jet propelled watercraft according to claim 1, wherein the reverse gate operation detector is configured to output a reverse gate position command signal in accordance with operation of the reverse gate operator; and the controller is configured or programmed to determine that the reverse gate operator is being operated when the reverse gate position command signal is being output.

4. The jet propelled watercraft according to claim 1, wherein the reverse gate operator includes a lever that is rotatingly operated by the operator.

5. The jet propelled watercraft according to claim 4, wherein the reverse gate operation detector is configured to detect an operation angle of the lever; and the controller is configured or programmed to determine that the reverse gate operator is being operated when the operation angle of the lever detected by the reverse gate operation detector is not less than a predetermined threshold.

6. The jet propelled watercraft according to claim 1, wherein the prime mover is an engine;

the jet propelled watercraft further comprises a starter motor configured to start the engine; and the controller is configured or programmed to determine, in accordance with the operation state of the reverse gate operator detected by the reverse gate operation detector, whether or not the reverse gate operator is being operated and programmed so as not to drive the starter motor when it is determined that the reverse gate operator is being operated.

7. The jet propelled watercraft according to claim 1, further comprising:

an accelerator operator operated by the operator to set a rotational speed of the prime mover; and an accelerator operation detector detecting an operation state of the accelerator operator; wherein the controller is configured or programmed to determine, in accordance with the operation state of the accelerator operator detected by the accelerator operation detector, whether or not the accelerator operator is being operated and to prohibit the startup of the prime mover when it is determined that the accelerator operator is being operated.

8. The jet propelled watercraft according to claim 7, wherein the reverse gate operation detector is configured to detect an operation amount of the reverse gate operator;

the accelerator operation detector is configured to detect an operation amount of the accelerator operator; and the controller is configured or programmed to determine that the reverse gate operator is being operated when the operation amount of the reverse gate operator detected by the reverse gate operation detector is not less than a predetermined first threshold and to determine that the accelerator operator is being operated when the operation amount of the accelerator operator detected by the accelerator operation detector is not less than a predetermined second threshold differing from the first threshold.

9. The jet propelled watercraft according to claim 8, wherein the reverse gate operator includes a reverse lever that is rotatingly operated by the operator;

the accelerator operator includes an accelerator lever that is rotatingly operated by the operator;

the operation amount of the reverse gate operator is an operation angle of the reverse lever; and the operation amount of the accelerator operator is an operation angle of the accelerator lever.

10. The jet propelled watercraft according to claim 8, wherein the reverse gate operator is configured to receive a setting of the rotational speed of the prime mover by the operator; and the rotational speed of the prime mover corresponding to the first threshold and the rotational speed of the prime mover corresponding to the second threshold are equal.

11. The jet propelled watercraft according to claim 8, wherein the reverse gate operator is configured to receive a setting of the rotational speed of the prime mover by the operator; and the rotational speed of the prime mover corresponding to the first threshold and the rotational speed of the prime mover corresponding to the second threshold differ.

12. The jet propelled watercraft according to claim 1, wherein the reverse gate operator is configured to receive a setting of the rotational speed of the prime mover provided by the operator.

13. The jet propelled watercraft according to claim 1, wherein the shift actuator is configured to move the reverse gate to the forward drive position, the reverse drive position, and a neutral position between the forward drive position and the reverse drive position; and the controller is configured or programmed to control the shift actuator to move the reverse gate to the neutral position when the prime mover is started up.

* * * * *